US007597323B2

(12) United States Patent
Taniguchi et al.

(10) Patent No.: US 7,597,323 B2
(45) Date of Patent: Oct. 6, 2009

(54) PAPER FEEDER AND IMAGE FORMING APPARATUS

(75) Inventors: Tadasu Taniguchi, Uda (JP); Norichika Katsura, Tenri (JP); Masahiko Fujita, Nara (JP); Yasunobu Ohkawa, Nara (JP); Masaya Asakawa, Yamatokoriyama (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 55 days.

(21) Appl. No.: 11/878,455

(22) Filed: Jul. 24, 2007

(65) Prior Publication Data

US 2008/0023911 A1 Jan. 31, 2008

(30) Foreign Application Priority Data

Jul. 28, 2006 (JP) ..... 2006-206516

(51) Int. Cl.
*B65H 5/02* (2006.01)

(52) U.S. Cl. ..... 271/265.04; 271/274

(58) Field of Classification Search ..... 271/274, 271/265.04, 272, 273, 2, 10.02
See application file for complete search history.

(56) References Cited

U.S. PATENT DOCUMENTS

| | | | | |
|---|---|---|---|---|
| 6,109,605 | A | 8/2000 | Hirota et al. | |
| 2002/0130463 | A1 * | 9/2002 | Michel | 271/274 |
| 2005/0184455 | A1 * | 8/2005 | Youn | 271/274 |
| 2007/0035085 | A1 * | 2/2007 | Abe et al. | 271/272 |

FOREIGN PATENT DOCUMENTS

| | | | |
|---|---|---|---|
| JP | 8-26505 | A | 1/1996 |
| JP | 11-180610 | A | 7/1999 |
| JP | 2000-240638 | A | 9/2000 |
| JP | 2000-313544 | A | 11/2000 |

* cited by examiner

*Primary Examiner*—Kaitlin S Joerger
(74) *Attorney, Agent, or Firm*—Birch, Stewart, Kolasch & Birch, LLP

(57) ABSTRACT

A paper feeder comprises an acquiring device, a driving roller, driven rollers, a driven roller supporter, a driver, and a controller. The acquiring device acquires thickness information on a sheet of paper. The driving roller rotates by being supplied with torque. The driven rollers rotate with the driving roller when in compressive contact with the driving roller. The driven roller supporter so supports the driven rollers that each of them can rotate under a different rotational load. The driver changes the position of the driven roller supporter relative to the driving roller. The controller selects one of the driven rollers on the basis of the thickness information and so activates the driver as to bring the selected roller into compressive contact with the driving roller.

9 Claims, 3 Drawing Sheets

PAPER FEEDER AND IMAGE FORMING APPARATUS

CROSS REFERENCE

This Nonprovisional application claims priority under 35 U.S.C. § 119(a) on Patent Application No. 2006-206516 filed in Japan on Jul. 28, 2006, the entire contents of which are hereby incorporated by reference.

BACKGROUND OF THE INVENTION

The present invention relates to a paper feeder for feeding a sheet of paper between its driving and driven rollers, which are kept in compressive contact with each other. The invention also relates to an image forming apparatus.

A commonly used paper feeder includes a driving roller and a driven roller which are kept in compressive contact with each other and feeds a sheet of paper between the two rollers. The driven roller is biased under a preset pressure against the driving roller by a spring or the like so that a preset nip pressure can be applied to a standard sheet of paper of a preset thickness between the two rollers.

In general, about 60-300 μm thick sheets of paper are used with image forming apparatus or the like. When the commonly used paper feeder feeds a sheet of paper different in thickness from the standard sheet, the radial force acting on the driven roller differs from that for the standard sheet, so that the rotational load on this roller differs from that for the standard sheet.

When the commonly used paper feeder feeds a sheet of paper thicker than the standard sheet, the nip pressure on the thicker sheet is higher, so that the rotational load on the driven roller is higher. As a result, the thicker sheet is fed at a lower speed. When this feeder feeds a sheet of paper thinner than the standard sheet, the nip pressure on the thinner sheet is lower, so that the rotational load on the driven roller is lower. As a result, the thinner sheet is fed at a higher speed, so that its leading end buckles.

The difference in the rotational load on the driven roller may cause the cylindrical surfaces of the driving and driven rollers to rub against each other. This damages the roller surfaces and sticks paper dust to them, thus causing a paper jam or another feed failure.

JP-2000-240638A discloses a feed roller including a sleeve and a shaft. The sleeve has an internal gear formed on its inside. An external gear is fixed to the shaft. When no radial force acts on the sleeve, the driving force of the shaft is not transmitted to the sleeve. When radial force acts on the sleeve, the two gears mesh together to transmit the driving force of the shaft to the sleeve. If high tension is exerted on a sheet of paper being fed by the feed roller, radial force acts on the sleeve, so that the driving force of the shaft is transmitted to the sleeve. This prevents the sheet from being broken.

The rotational load on the feed roller can be switched between only two levels either to transmit the driving force of the shaft or not to transmit it to the sleeve. Accordingly, it is impossible to adjust the rotational load for various types of paper different in thickness. As a result, it is impossible for the feed roller to smoothly feed some types of paper different in thickness.

A driver is necessary for changing the rotational load on the feed roller. The feed roller is complex in structure, so that its manufacturing cost is high.

SUMMARY OF THE INVENTION

The object of the present invention is to provide a paper feeder which can smoothly feed various types of paper different in thickness.

A paper feeder according to the present invention comprises an acquiring device, a driving roller, driven rollers, a driven roller supporter, a driver, and a controller. The acquiring device acquires thickness information on a sheet of paper. The driving roller rotates by being supplied with torque. The driven rollers rotate with the driving roller when in compressive contact with the driving roller. The driven roller supporter so supports the driven rollers that each of them can rotate under a different rotational load. The driver changes the position of the driven roller supporter relative to the driving roller. The controller selects one of the driven rollers on the basis of the thickness information and so activates the driver as to bring the selected roller into compressive contact with the driving roller.

DETAILED DESCRIPTION OF THE INVENTION

Figure 1:
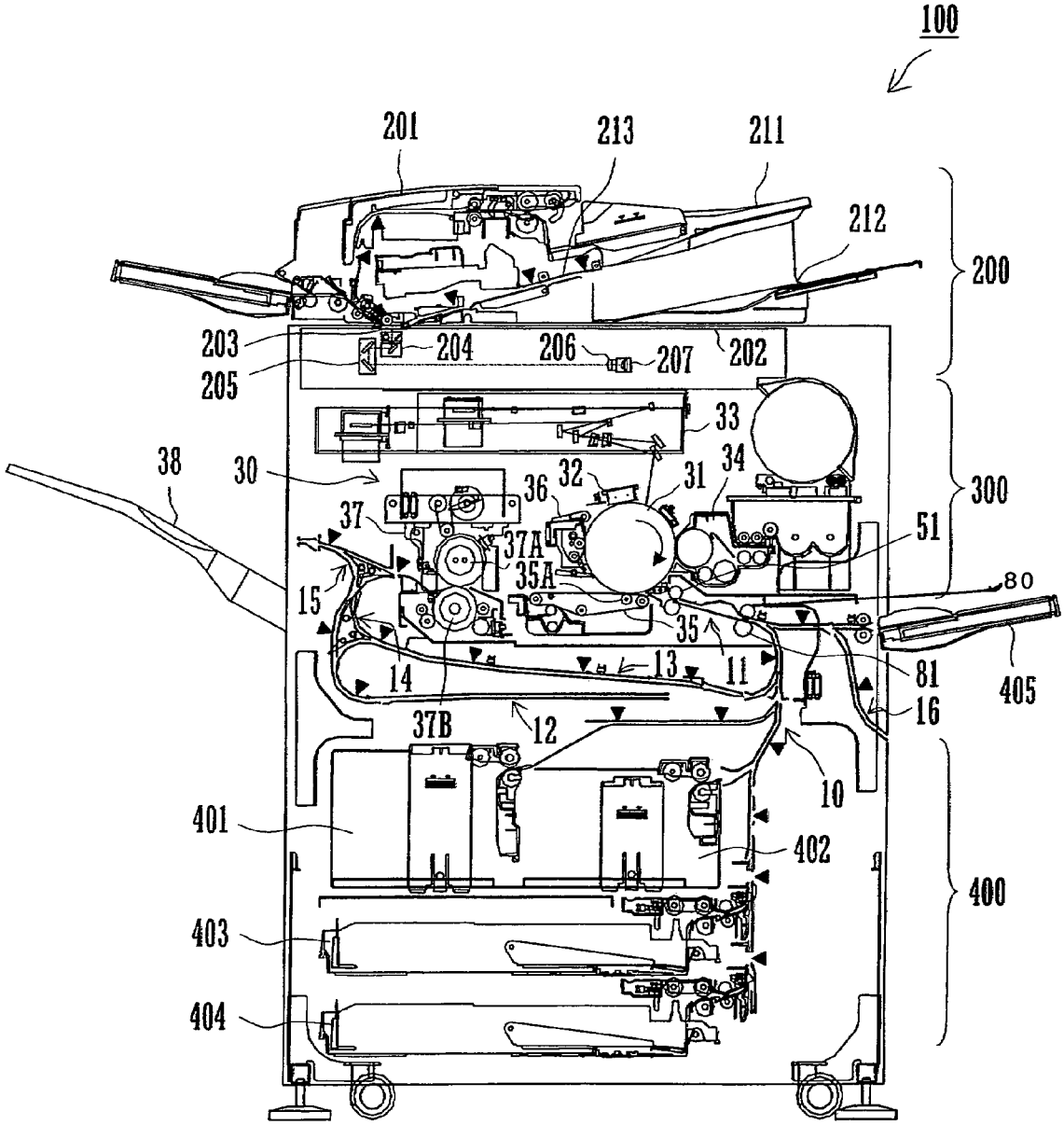
FIG. 1 is a sectional front view of an image forming apparatus according to an embodiment of the present invention.

The best mode of carrying out the present invention will be described below with reference to the accompanying drawings. FIG. 1 shows an image forming apparatus 100 according to an embodiment of the present invention. The apparatus 100 includes an image reading unit 200, an image recording unit 300, and a paper feeding unit 400.

The image reading unit 200 includes an automatic document feeder (ADF) 201, a first document platform 202, a second document platform 203, a first mirror base 204, a second mirror base 205, a lens 206, and a charge coupled device (CCD) 207.

The ADF 201 has a document feeding passage 213 formed in it and extending from a document tray 211 via the second document platform 203 to an outlet tray 212. The ADF 201 feeds documents one by one from the document tray 211 to the feeding passage 213. The rear edge of the ADF 201 is supported pivotably in such a manner that the ADF can cover the top of the first document platform 202. By raising the front edge of the ADF 201 so as to expose the first document platform 202, it is possible to place a document manually on this platform.

The document platforms 202 and 203 are a hard glass plate.

The mirror bases 204 and 205 are supported horizontally movably under the document platforms 202 and 203. The speed at which the second mirror base 205 moves is ½ of the speed at which the first mirror base 204 moves. The first mirror base 204 carries a light source and a first mirror. The second mirror base 205 carries a second mirror and a third mirror.

The image on a document being fed by the ADF 201 is read with the first mirror base 204 stopping under the second document platform 203. The light source on the first mirror base 204 under the second document platform 203 radiates light to the front side of the document passing over this platform. The light reflected by this side of the document is then reflected by the first mirror on the first mirror base 204 toward the second mirror base 205.

The image on a document placed on the first document platform 202 is read with the mirror bases 204 and 205 moving horizontally under this platform. The light source on the first mirror base 204 moving under the first document platform 202 radiates light to the front side of the document on this platform. The light reflected by this side of the document is then reflected by the first mirror on the first mirror base 204 toward the second mirror base 205.

Whether the ADF 201 is used or not, the light reflected by the front side of the document is incident on the CCD 207 via the lens 206 by means of the second and third mirrors on the second mirror base 205, with the optical path length constant.

The CCD 207 outputs an electric signal based on the quantity of light reflected by the front side of the document. The electric signal is input as image data into the image forming unit 300.

The image recording unit 300 includes an image former 30 consisting of a photosensitive drum 31, a charging device 32, an exposure device 33, a developing device 34, a transfer belt 35, a cleaner 36, and a fixing device 37.

The photosensitive drum 31 has a photosensitive layer formed on its cylindrical surface and rotates clockwise in FIG. 1. The charging device 32 charges the drum surface uniformly to a preset electric potential. The charging device 32 may be either a non-contact type charging device with a charger or a contact type charging device with a roller or a brush.

The exposure device 33 irradiates the cylindrical surface of the photosensitive drum 31 with light based on the image data. Photoconduction in the photosensitive layer of the drum 31 forms an electrostatic latent image on the irradiated surface of the drum 31. The exposure device 33 scans the drum surface axially of the drum 31 by means of a polygon mirror with a laser beam modulated with the image data. Alternatively, the exposure device 33 might be replaced by an exposure device having an array of ELs, LEDs, or other light emitting devices.

The developing device 34 supplies the cylindrical surface of the photosensitive drum 31 with toner so as to make the electrostatic latent image visible.

The transfer belt 35 forms a loop around rollers under the photosensitive drum 31 and has a resistance between about $1\times10^{9}$ and $1\times10^{13}$ Ωcm. A transfer roller 35A is supported inside the transfer belt 35 and biased to keep it in compressive contact with the cylindrical surface of the photosensitive drum 31. A transfer voltage is applied to the transfer roller 35A. The toner image on the drum 31 is transferred to a sheet of paper passing between the drum and the transfer belt 35.

The cleaner 36 removes the toner remaining on the portion of the drum surface from which the toner image has been transferred.

The fixing device 37 includes a heating roller 37A and a pressing roller 37B. The heating roller 37A has a heater fitted in it for heating it to a temperature at which the toner on this roller can melt. The pressing roller 37B is biased under a preset pressure against the heating roller 37A. While the sheet with the toner image on it is passing between the rollers 37A and 37B, the fixing device 37 heats and presses the sheet so as to fix the image fast on the sheet. After passing through the fixing device 37, the sheet is discharged to an outlet tray 38, which is fitted on the right (left in FIG. 1) side of the image forming apparatus 100.

The paper feeding unit 400 includes four feed cassettes 401-404 and a manual feed tray 405. Each of the feed cassettes 401-404 holds sheets of paper of a size. The manual feed tray 405 supports a sheet of paper of size or quality for less frequent use.

The paper feeding unit 400 feeds sheets of paper one after one from one of the four feed cassettes 401-404 or the manual feed tray 405. A sheet of paper fed from the paper feeding unit 400 is then fed to the image former 30 through paper feeding passages 10 and 11 by a paper feeder 80.

A pair of resist rollers 51 is supported downstream from the paper feeder 80 in the paper feeding direction in which sheets of paper are fed through the feeding passages 10 and 11. The axes of the resist rollers 51 are perpendicular to the paper feeding direction. With the resist rollers 51 stopping, the leading end of the sheet being fed by the paper feeder 80 is forced against the nip between these rollers. As a result, if the sheet makes an angle with the paper feeding direction, the position of the sheet is corrected.

The resist rollers 51 rotate to feed the sheet to the position between the photosensitive drum 31 and the transfer belt 35. The start of the rotation of the resist rollers 51 is so timed that the leading end of the sheet registers with the leading end of a toner image formed on the drum 31. After the toner image is transferred and fixed to the sheet in the ways described already, the sheet is delivered to the outlet tray 38.

A large capacity cassette (LCC) for holding a large number of sheets of paper may be positioned under the manual feed tray 405 on the left (right in FIG. 1) side of the image forming apparatus 100. A sheet of paper from the LCC is fed to the image former 30 through a paper feeding passage 16.

Figure 2:
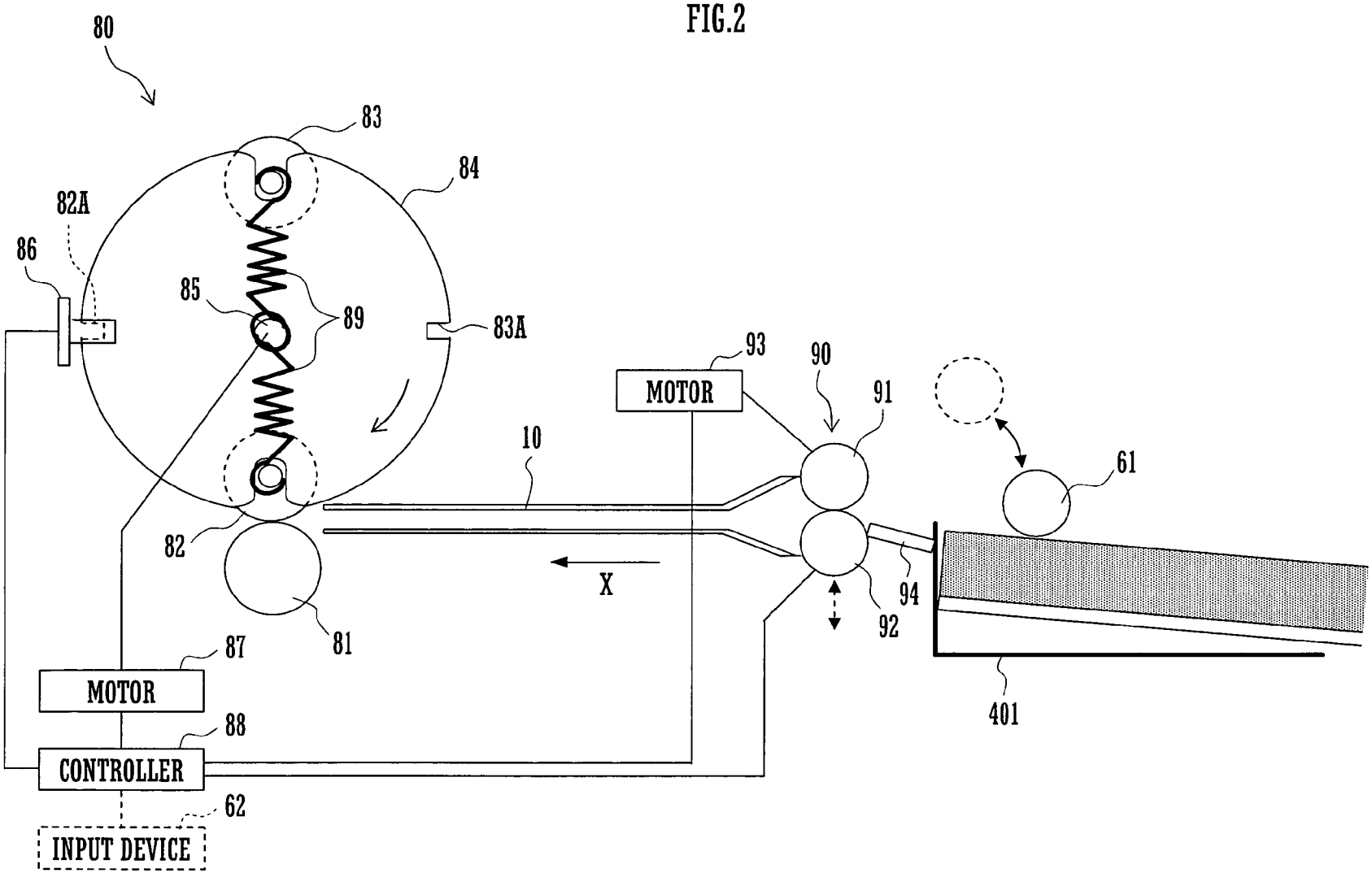
FIG. 2 is a sectional front view of the paper feeder of the image forming apparatus.

With reference to FIG. 2, the paper feeder 80 includes a driving roller 81, a first driven roller 82, a second driven roller 83, a pair of turning disks 84 and 84A (not shown), a disk shaft 85, a position sensor 86, a motor 87, a controller 88, and pairs of feed rollers 90. The position sensor 86 corresponds to the detector of the present invention.

The disk shaft 85 is supported rotatably and perpendicularly to the paper feeding direction X. Each end of the disk shaft 85 is fixed to the center of one of the turning disks 84 and 84A.

Each of the turning disks 84 and 84A has a first recess and a second recess which are formed in its outer periphery. The two recesses of each of the turning disks 84 and 84A extend radially of the disk. The first and second recesses of each of the turning disks 84 and 84A are aligned with the first and second recesses respectively of the other disk axially of the disks.

A sliding bearing (not shown) is in slidable engagement with each of the first recesses and can slide radially of the associated disk. The sliding bearing on each of the turning disks 84 and 84A supports one end of the shaft of the first driven roller 82. A ball bearing (not shown) is in slidable engagement with each of the second recesses and can slide radially of the associated disk. The ball bearing on each of the turning disks 84 and 84A supports one end of the shaft of the second driven roller 83.

As stated above, the turning disks 84 and 84A support the driven rollers 82 and 83. Alternatively, the turning disks 84 and 84A may support three or more driven rollers. If the paper feeder 80 included a number of driven rollers different in rotational load, it could smoothly feed more types of paper different in thickness. As far as the driven rollers differ in rotational load, they might be supported by bearings other than sliding bearings and ball bearings.

The driven rollers 82 and 83 can shift within a preset range radially of the turning disks 84 and 84A. Each of the driven rollers 82 and 83 is biased under a preset pressure away from the disk shaft 85 radially of the turning disks 84 and 84A by a spring 89 or another elastic member. When positioned between the driving roller 81 and disk shaft 85, each of the driven rollers 82 and 83 is in compressive contact with the driving roller at a preset pressure. By way of example, the diameter of the driving roller 81 ranges suitably between 6 and 8 mm.

The turning disk 84 has two notches 82A and 83A for position sensing which are formed in its outer periphery. The notch 82A is sensed by the position sensor 86, which may be an optical sensor, when the first driven roller 82 comes into compressive contact with the driving roller 81. The notch 83A is sensed by the position sensor 86 when the second driven roller 83 comes into compressive contact with the driving roller 81. The position sensor 86 outputs the sensing results to the controller 88.

The controller 88 controls the motor 87 as a driver, which drives the disk shaft 85 to turn the turning disks 84 and 84A. The controller 88 activates the motor 87 to turn the turning disks 84 and 84A in a predetermined direction so as to bring selectively one of the driven rollers 82 and 83 into compressive contact with the driving roller 81. By way of example, the turning disks 84 and 84A turn clockwise in FIG. 2 (in the direction in which the driven rollers 82 and 83 pass over the driving roller 81 in the feeding direction X). By turning the turning disks 84 and 84A in only one direction, it is possible to nip a sheet of paper uniformly between the driving roller 81 and each of the driven rollers 82 and 83.

The feed rollers 90 are supported upstream from the driving and driven rollers 81-83 in the feeding direction X. Each pair of feed rollers 90 is positioned near the front end of one of the feed cassettes 401-404 and manual feed tray 405.

A pickup roller 61 is normally positioned away from the sheets in each of the feed cassettes 401-404 and shifts downward into compressive contact with the top sheet in the cassette to feed this sheet.

Each pair of feed rollers 90 consists of a first feed roller 91 and a second feed roller 92. A motor 93 rotates the first feed roller 91. The second feed roller 92 is biased against the first feed roller 91 and rotates with it. The driving load exerted on the motor 93 when the associated feed rollers 90 feed a sheet of paper is output to the controller 88, which acquires thickness information representing the thickness of the sheet in proportion to the driving load. It is possible to acquire thickness information on a sheet of paper easily by acquiring the thickness information based on the driving load on the motor 93 rotating the feed rollers 90 to feed the sheet.

The sheet fed by the pickup roller 61 is then fed by the associated feed rollers 90 through the feeding passage 10 to the nip between the driving roller 81 and one of the driven rollers 82 and 83. By way of example, the height of the feeding passage 10 ranges suitably between 2 and 3 mm.

The controller 88 selects one of the driven rollers 82 and 83 on the basis of the thickness information and activates the motor 87 to turn the turning disks 84 and 84A so as to bring the selected roller into compressive contact with the driving roller 81.

Because the driven roller 82 or 83 selected on the basis of the thickness information comes into compressive contact with the driving roller 81, the rotational load exerted on the selected roller when this roller and the driving roller feed sheets of paper is constant for different sheet thicknesses. This enables the paper feeder 80 to smoothly feed many types of paper different in thickness. If the paper feeder 80 included a number of driven rollers different in rotational load, it could smoothly feed more types of paper.

Figure 3:
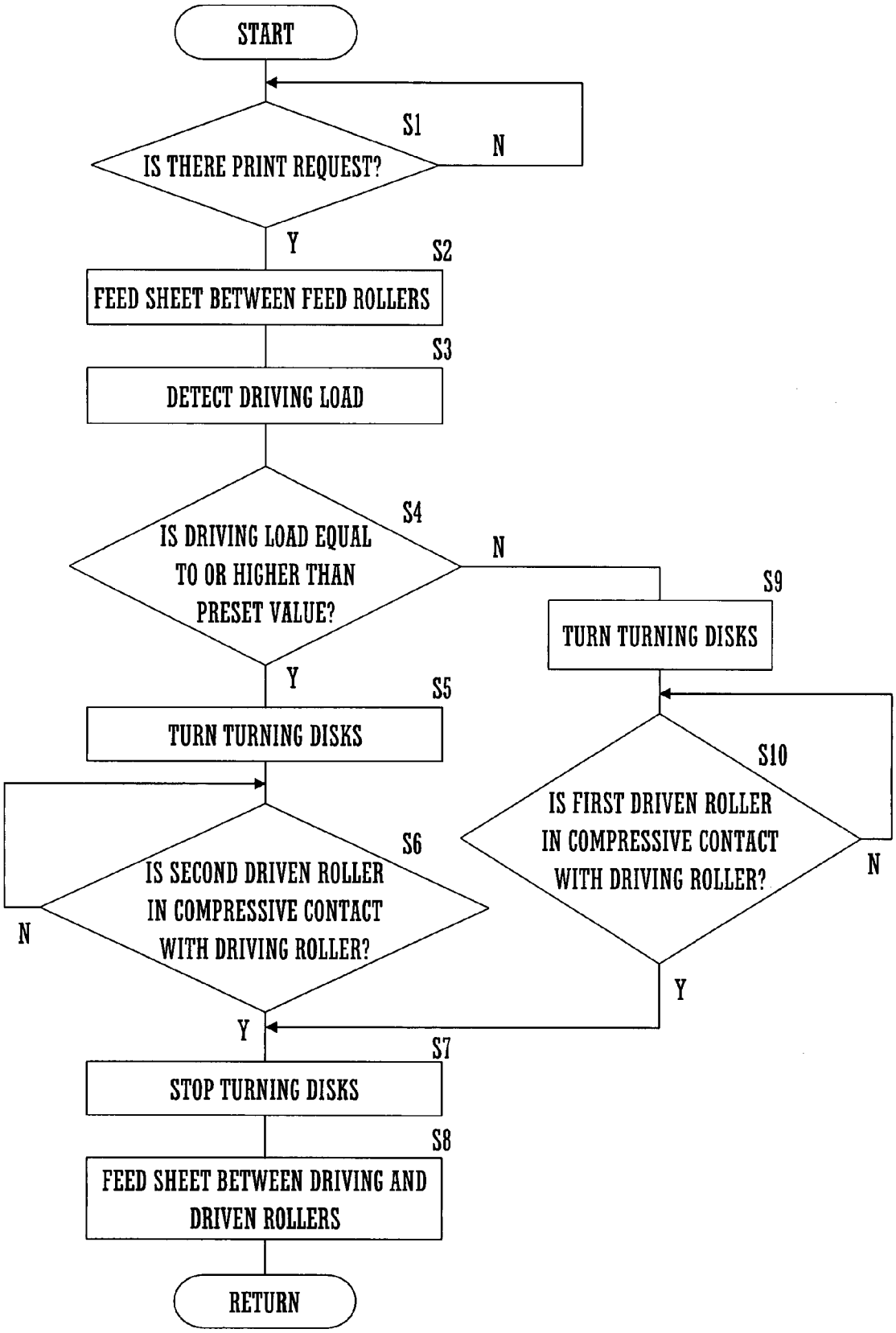
FIG. 3 is a flowchart of a process carried out by the controller of the image forming apparatus.

FIG. 3 shows a process carried out by the controller 88. In response to a print request (S1), the controller 88 causes the pickup roller 61 associated with the feed cassette 401, 402, 403, or 404 holding the appropriate type of paper to come into compressive contact with the top sheet in this cassette and rotate so as to feed the sheet to the paper feeding passage 10 (S2).

The controller 88 acquires the thickness information on this sheet by detecting the driving load on the motor 93 driving the pair of feed rollers 90 feeding the sheet (S3). The controller 88 determines whether the detected load is not lower than a preset value (S4).

If the detected load is not lower than the preset value, the controller 88 makes the turning disks 84 and 84A turn (S5) and determines on the basis of the sensing result from the position sensor 86 whether the second driven roller 83, which is supported by the ball bearings, has come into compressive contact with the driving roller 81 (S6) If the controller 88 determines that the second driven roller 83 has come into compressive contact with the driving roller 81, the controller makes the turning disks 84 and 84A stop turning (S7). Then, the controller 88 makes the driving roller 81 and second driven roller 83 feed the sheet (S8).

If the detected load is lower than the preset value (S4), the controller 88 makes the turning disks 84 and 84A turn (S9) and determines on the basis of the sensing result from the position sensor 86 whether the first driven roller 82, which is supported by the sliding bearings, has come into compressive contact with the driving roller 81 (S10) If the controller 88 determines that the first driven roller 82 has come into compressive contact with the driving roller 81, the controller makes the turning disks 84 and 84A stop turning (S7). Then, the controller 88 makes the driving roller 81 and first driven roller 82 feed the sheet (S8).

A parting member 94 may be positioned between each of the feed cassette 401-404 and the associated pair of feed rollers 90. If two or more sheets of paper are fed from one of the feed cassette 401-404 at the same time, the associated parting member 94 feeds only one of the sheets to the associated feed rollers 90. This prevents two or more sheets of paper from being fed to the feed rollers 90, so that the controller 88 can acquire accurate thickness information on one sheet from these rollers.

Each second feed roller 92 could be displaced relative to the axis of the associated first feed roller 91 according to the thickness of a sheet of paper being fed between these rollers. In this case, the controller 88 acquires thickness information based on the displacement of the second feed roller 92. The acquisition of thickness information based on the displacement of the second feed roller 92 makes it possible to acquire accurate thickness information on a sheet of paper.

The image forming apparatus 100 may be fitted with an input device 62 through which the user can enter thickness information on sheets of paper. The controller 88 acquires the entered information. This makes it possible to acquire thickness information without the necessity of a device for measuring sheet thickness.

It should be considered that the foregoing description of the embodiment is illustrative in all respects and not restrictive. The scope of the present invention is defined by the appended claims, not by the embodiment, and intended to include meanings equivalent to those of the elements of the claims and all modifications in the claims.

What is claimed is:

1. A paper feeder, comprising:

an acquiring device for acquiring thickness information on a sheet of paper;

a driving roller for rotating by being supplied with torque;

a plurality of driven rollers for rotating with the driving roller when in compressive contact with the driving roller;

a driven roller supporter for supporting the driven rollers such that each of the driven rollers can rotate under a different rotational load;

a driver for changing the position of the driven roller supporter relative to the driving roller; and a controller for selecting one of the driven rollers on the basis of the acquired thickness information and activating the driver to bring the selected roller into compressive contact with the driving roller, wherein the acquiring device includes feed rollers supported near an end of a feed unit holding sheets of paper, the end being downstream in the feeding direction in which the paper feeder feeds the sheet, and wherein the acquiring device acquires the thickness information on the basis of the force acting on the feed rollers.

2. A paper feeder as claimed in claim 1, wherein the driven roller supporter includes bearings of different types each supporting one of the driven rollers.

3. A paper feeder as claimed in claim 1, wherein the acquiring device acquires the thickness information on the basis of the driving load acting on the feed rollers feeding the sheet.

4. A paper feeder as claimed in claim 1, wherein the feed rollers are:

a first roller to which driving force can be transmitted and a second roller for rotating in compressive contact with the first roller;

the second roller being capable of being displaced relative to the axis of the first roller according to the thickness of the sheet being fed between the first and second rollers;

the acquiring device being adapted to acquire the thickness information on the basis of the displacement of the second roller.

5. A paper feeder as claimed in claim 1, wherein the acquiring device includes an input device into which the thickness information can be input.

6. A paper feeder as claimed in claim 1, wherein the driven roller supporter includes a turning disk for turning on an axis perpendicular to the feeding direction in which the paper feeder feeds the sheet, the turning disk supporting the driven rollers at different peripheral positions thereon.

7. A paper feeder as claimed in claim 6, further comprising:

a detector for detecting the position of the turning disk around the disk axis.

8. A paper feeder as claimed in claim 6, wherein the driven roller supporter turns the turning disk in a predetermined direction.

9. An image forming apparatus for forming an image on a sheet, comprising:

the paper feeder as claimed in claim 1.

* * * * *